US005646589A

United States Patent [19]

Murray et al.

[11] Patent Number: 5,646,589

[45] Date of Patent: Jul. 8, 1997

[54] ELECTRONIC DEVICE HAVING SELECTABLE ALERT MODES

[75] Inventors: Nancy Murray, Morris Township, Morris County; David Phillip Silverman, Somerville, both of N.J.

[73] Assignee: Lucent Technologies Inc., Murray Hill, N.J.

[21] Appl. No.: 359,109

[22] Filed: Dec. 19, 1994

[51] Int. Cl.[6] ..... G08B 3/00; G08B 5/22

[52] U.S. Cl. ..... 340/384.1; 340/311.1; 340/825.44; 340/825.46; 381/57

[58] Field of Search ..... 340/384.1, 311.1, 340/825.44, 825.45, 825.46, 825.47, 825.48; 381/57

[56] References Cited

U.S. PATENT DOCUMENTS

| | | | |
|---|---|---|---|
| 4,904,992 | 2/1990 | Grothause | 340/825.44 |
| 4,918,438 | 4/1990 | Yamasaki | 340/311.1 |
| 5,093,658 | 3/1992 | Grothause | 340/311.1 |
| 5,189,389 | 2/1993 | De Luca et al. | 340/311.1 |

*Primary Examiner*—Donnie L. Crosland

[57] ABSTRACT

In a noisy environment, e.g., a car traveling down the road with the radio playing, a user who prefers that his pager provide him with an audible alert in response to an actuation of the pager may not be able to hear such an audible alert supplied by the pager. To overcome this difficulty, a pager that is set to an audible alert mode is arranged to change its alerting for a particular actuation of the pager from audible to tactile only when the ambient sound level of the environment in which the pager is located is greater than a predetermined threshold level. For each actuation of the pager that the ambient sound level in the environment in which the pager is located is less than the predetermined threshold level, the pager alerts audibly. Optionally, if the pager also determines that it is no longer being worn on the person of a user, the pager alerts audibly regardless of whether the ambient sound level is greater than the predetermined threshold level. Advantageously, as much of the time as feasible the user receives only the type of alert he desires, namely audible, while receiving the alternative form of alert, namely tactile, only when necessary to avoid loss of the page by the failure of the use to perceive the alert.

7 Claims, 2 Drawing Sheets

ELECTRONIC DEVICE HAVING SELECTABLE ALERT MODES

TECHNICAL FIELD

This invention relates in general to selectable alert modes for electronic devices such as pagers and telephones.

BACKGROUND OF THE INVENTION

It is well known that pagers typically alert their users to receipt of a page by supplying either an audible alert, which may be heard by the user, or a tactile alert, such as a vibrating sensation that may be felt by the user. It is also well known that in particular situations a user may prefer an audible alert while in other situations the user may prefer a tactile alert. However, it has been recognized that in certain situations the user's preference may result in an inadequate alert. Therefore, U.S. Pat. No. 4,918,438 issued to Yamasaki on Apr. 17, 1990 describes a pager that sequentially employs two alerting modes, first alerting with a tactile alert and then alerting with an audible alert. U.S. Pat. No. 5,189,389 issued to DeLuca et al. on Feb. 23, 1993 describes a pager that automatically changes its alerting mode from tactile to audible when it determines that it is no longer being worn on the person of a user or when it is in a charging case, since a tactile alert cannot be detected when the pager is not worn on the person of the user and such an alert can damage the charger.

SUMMARY OF THE INVENTION

We have recognized that there are users who prefer only an audible alert. However, in a noisy environment, e.g., a car traveling down the road with the radio playing, a user may not be able to hear the audible alert supplied by the pager. To overcome this difficulty, in accordance with the principles of the invention, a pager that is set to an audible alert mode is arranged to change its alerting for a particular actuation of the pager from audible to tactile only when the ambient sound level of the environment in which the pager is located is greater than a predetermined threshold level. For each actuation of the pager that the ambient sound level in the environment in which the pager is located is less than the predetermined threshold level, the pager alerts audibly. Optionally, in accordance with an aspect of the invention, if the pager also determines that it is no longer being worn on the person of a user, the pager alerts audibly regardless of whether the ambient sound level is greater than the predetermined threshold level. Advantageously, as much of the time as feasible the user receives only the type of alert he desires, namely audible, while receiving the alternative form of alert, namely tactile, only when necessary to avoid loss of the page by the failure of the user to perceive the alert.

DETAILED DESCRIPTION

Figure 1:
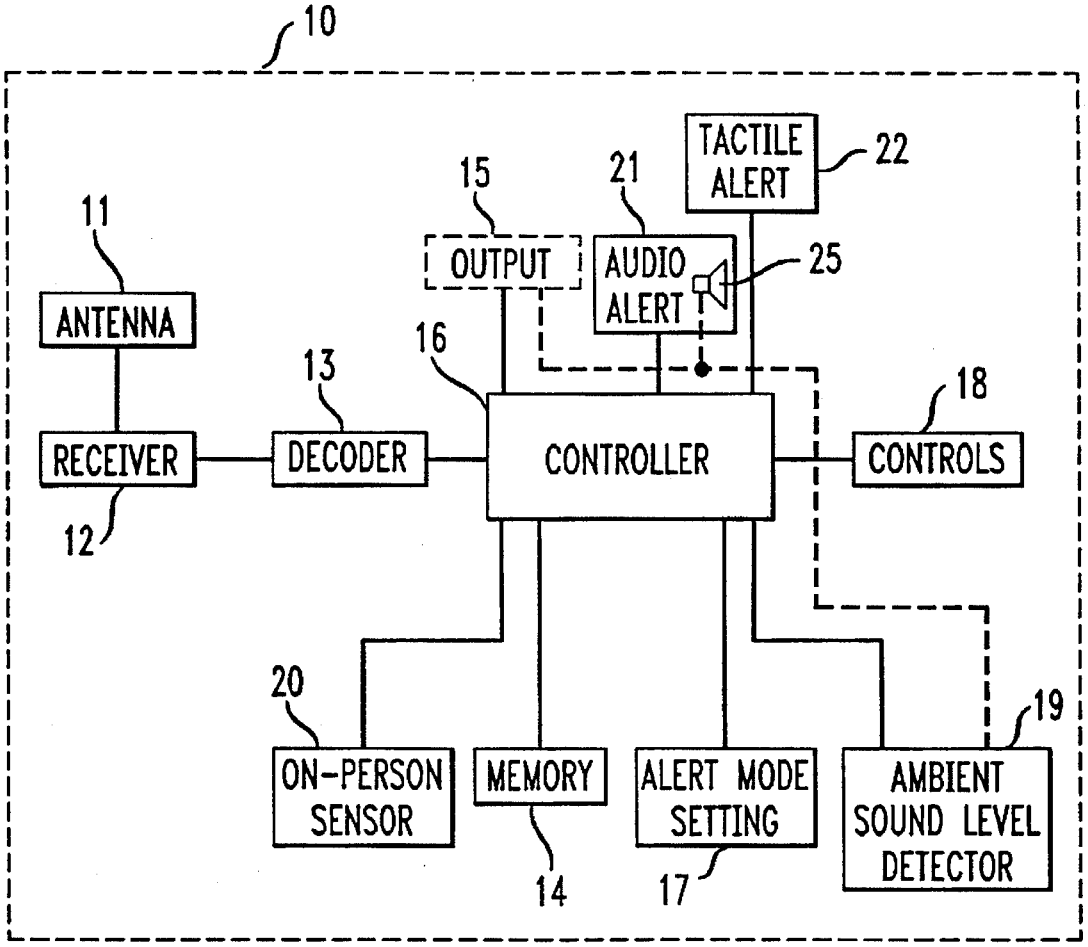
FIG. 1 shows exemplary selective call radio receiver, e.g., a pager that, when set to an audible alert mode, changes its alerting for a particular actuation of the pager from audible to tactile if the ambient sound level of the environment in which the pager is located is greater than a predetermined threshold level, in accordance with the principles of the invention.

FIG. 1 shows exemplary selective call radio receiver 10, e.g., a pager that, when set to an audible alert mode, changes its alerting for a particular actuation of the pager from audible to tactile if the ambient sound level of the environment in which the pager is located is greater than a predetermined threshold level, in accordance with the principles of the invention. Pager 10 includes a) antenna 11, b) receiver module 12, c) decoder 13, d) memory 14, e) optional output module 15, f) controller 16, g) alert mode setting 17, h) controls 18, i) ambient sound level detector 19, j) on-person sensor 20, k) audio alert 21, and 1) tactile alert 22.

Antenna 11 provides a radio frequency (RF) signal that is mixed with a local oscillator signal and an injection signal contained within receiver module 12. Receiver module 12 also generates a signal suitable for processing by decoder 13 in a manner well known to those skilled in the art. Decoder 13 converts the signal from receiver module 12 to an address which may also include optional message data directed to some selective call receivers. If the selective call receiver includes an optional voice output, recovered audio components of the original RF signal may also be received by antenna 11.

Controller 16 compares the decoded results with predetermined addresses contained in memory 14, and when substantially similar, alerts the user that a signal has been received, either via 1) audio alert 21, e.g., a) a driver and b) electrical-to-acoustic transducer 25, such as a speaker or piezoelectric alerter, or 2) tactile alert 22, e.g., a) a driver and b) a vibrator.

For a message or voice selective call receiver, the recovered message or voice output is stored in memory 14 for subsequent "playback" by optional output module 15. Output module 15 automatically, or when manually selected by controls 18, presents the contents of received messages, such as by displaying such messages on a display or reconstructing an audio signal.

Alert mode setting 17 indicates the user's selected alert mode. The alert mode indicates the type of alerting e.g., audible or tactile, that the user desires for the next actuation of pager 10. Alert mode setting 17 may be a switch that is set to a position that indicates the user's choice of alerting mode. Alternatively, alert mode setting 17 may be a storage location, such as a memory, in which a value indicating the desired alert mode is stored. If alert mode setting 17 is a memory, it may be a part of memory 14. Also, if alert mode setting 17 is a memory, its content are set by controller 16 in response to the user entering commands via controls 18.

Ambient sound level detector 19 determines the level of ambient sound in the vicinity of the pager. For example, as is well known in the art, ambient sound level detector 19 may contain a) an acoustic-to-electrical transducer, e.g., a microphone, b) a sample and hold circuit, and c) an analog to digital converter. The output of the analog to digital converter may then be compared against a predetermined threshold stored in memory 14. Alternatively, ambient sound level detector 19 may contain a microphone and an analog, e.g., op-amp based, comparator biased to a predetermined level. When the ambient sound level exceeds a predetermined level the output of the comparator is a logic 1, otherwise it is a logic 0. Controller 19 reads as an input the output of the comparator, and so is able to determine if the ambient sound level exceeds the predetermined level.

In one embodiment of the invention, ambient sound level detector 19 employs as the acoustic-to-electrical transducer the same device as is employed by audio alert 21 to generate the audible alert, e.g., the speaker or piezoelectric alerter used as transducer 25. It is noted that transducer 25 may also be used by output module 15 for use in playing back voice messages.

On-person sensor 20 determines if the pager is located on the person of a user. This may be done for example, determining the relationship of the pager to another object, such as a battery charger, a belt clip, an article of clothing, a land mass such as the earth, as well as the position of the pager with respect to the other object. For example, a mercury switch may be used to sense gravity and hall effect sensors to determine the orientation of the pager. Other techniques will be readily apparent to those skilled in the art.

Figure 2:
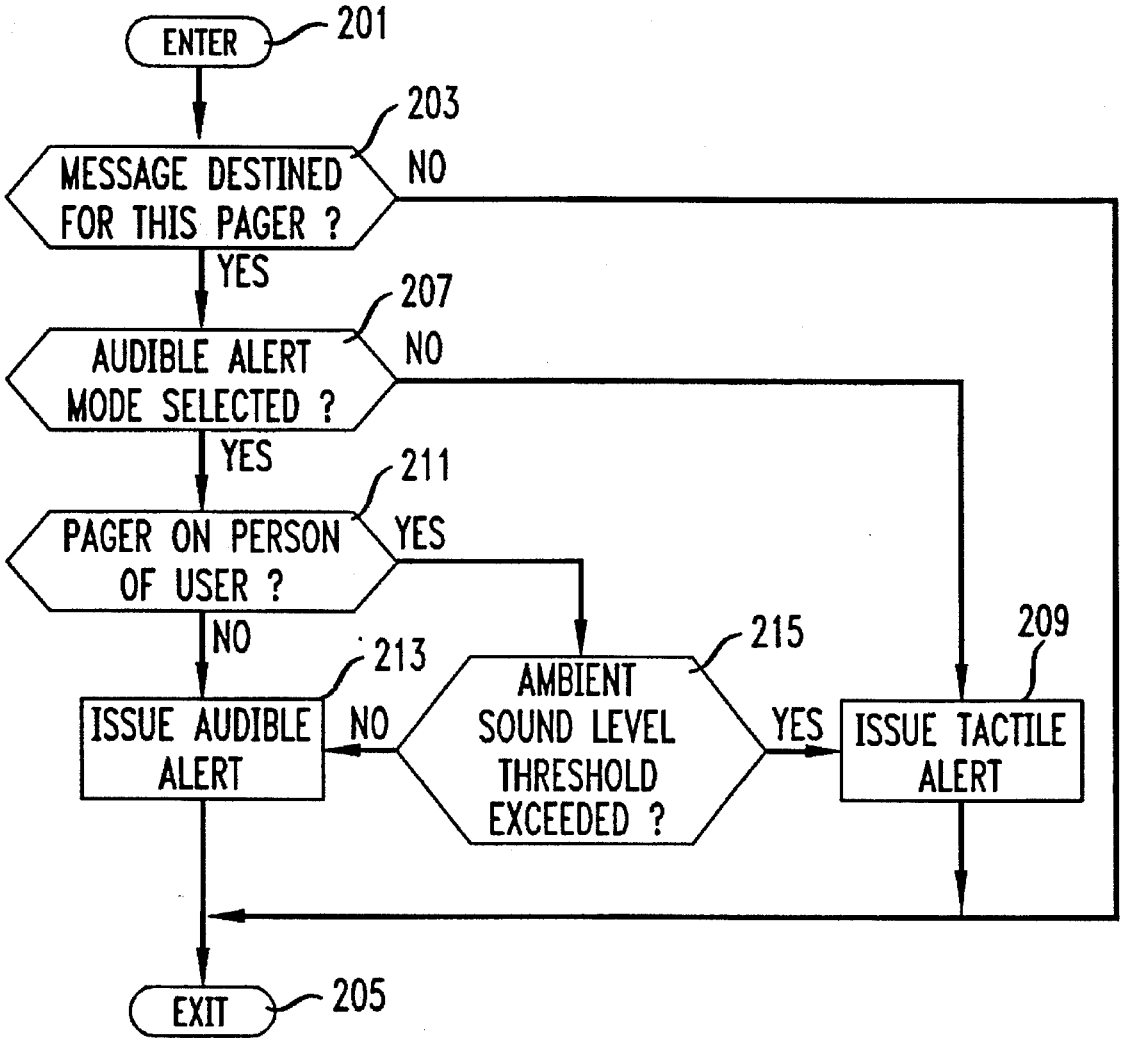
FIG. 2 shows an exemplary process for carrying out the invention.

FIG. 2 shows an exemplary process for carrying out the invention. The process is entered in step 201 when a paging signal is received at antenna 11, passed for processing by receiver 12, and then decoded by decoder 13. Thereafter, in step 203, controller 16 tests to determine if the message in the received paging signal is destined for this pager. The test is performed by comparing a portion of the decoded results with a predetermined address contained in memory 14. If the test result in step 203 is NO, as determined from the fact that the received decoded address does not match the stored predetermined address, control passes to step 205 and the process is exited.

If the test result in step 203 is YES, as determined from the fact that the received decoded address substantially matches the stored predetermined address, control passes to conditional branch point 207, which tests to determine if audible alert mode has been selected by the user. This test may be performed by checking the state of, or value stored in, alert mode setting 17. If the test result in step 207 is NO, indicating that the user has selected some other alert mode, e.g., tactile alert mode, control passes to step 209 and pager 10 issues a tactile alert in the conventional manner, by activating tactile alert 22. The process then exits in step 205.

If the test result in step 207 is YES, indicating that the user has selected audible alert mode, control passes to optional conditional branch point 211, which tests to determine if pager 10 is located on the person of the user. This test may be performed by checking the status of on-person sensor 20. If the test result in step 211 is NO, indicating that pager 10 is not on the person of the user, in accordance with an aspect of the invention, control passes to step 213, in which an audible alert is issued by audio alert 21. The process then exits in step 205.

If the test result in step 211 is YES, indicating that pager 10 is indeed on the person of the user, control passes to conditional branch point 215, which tests to determine, in accordance with the principles of the invention, if the ambient sound level exceeds a predetermined threshold. The test of step 215 may be performed by ambient sound level detector 19 alone or in conjunction with controller 16. If the test result in step 215 is YES, indicating that the ambient sound level exceeds the predetermined threshold, in accordance with the principles of the invention, control passes to step 209 and a tactile alert is issued, despite the user having selected audible alert mode. The process then exits in step 205. If the test result in step 215 is NO, indicating that the ambient sound level does not exceed the predetermined threshold, control passes to step 213 and an audible alert is issued in the conventional manner. The process then exits in step 205.

Those skilled in the art will recognize that the principle of the invention may be advantageously employed in hand-held or pocket telephones and personal digital assistants.

The foregoing merely illustrates the principles of the invention. It will thus be appreciated that those skilled in the art will be able to devise various arrangements which, although not explicitly described or shown herein, embody the principles of the invention and are thus within its spirit and scope.

We claim:

1. A pager comprising:

means for setting an audible alert mode for said pager;

means for determining an ambient sound level in the environment of said pager in response to a particular actuation of said pager;

means, responsive to said pager being set to an audible alert mode by said means for setting, for activating said pager to issue a tactile alert for said particular actuation of said pager only if said ambient sound level is greater than a predetermined threshold level at a time of said particular actuation; and means for sensing whether or not said pager is on the person of a user of said pager, wherein said means for activating is also responsive to said means for sensing so as to activate said pager to issue said tactile alert only if said means for sensing senses that said pager is on the person of a user.

2. A method for use in a pager comprising the steps of:

setting an audible alert mode for said pager;

determining an ambient sound level in the environment of said pager in response to a particular actuation of said pager;

issuing a tactile alert for said particular actuation of said pager even though said pager is set to said audible alert mode, said tactile alert being issued only if said ambient sound level is greater than a predetermined threshold level at a time of said particular actuation; and sensing whether or not said pager is on the person of a user prior to said issuing step, and wherein said issuing step is only performed if said pager is sensed to be on the person of a user.

3. A pager having audible alert means and tactile alert means and means for selectively activating either said audible alert means or said tactile alert means in response to an incoming page, said pager comprising:

means for setting said pager to one of a plurality of alert modes, said plurality of alert modes including at least an audible alert mode;

means for determining an ambient sound level in the environment of said pager in response to said incoming page; and means for sensing whether or not said pager is on the person of a user of said pager;

wherein said means for selectively activating activates said tactile alert means when (i) said pager is set to said audible alert mode by said means for setting, (ii) said ambient sound level, as determined by said means for determining, is greater than a predetermined threshold level at a time of said incoming page and (iii) said means for sensing senses that said pager is on the person of a user.

4. The invention as defined in claim 3 wherein said audible alert means and said means for determining an ambient sound level share a common electro-acoustic transducer.

5. A method for use in issuing an audible alert or a tactile alert from a pager set in an audible alert mode in response to actuation of said pager, the method comprising the step of issuing a tactile alert only if an ambient sound level is greater than a predetermined level at a time of said particular actuation, wherein said tactile alert is issued only when said pager is located on the person of a user.

6. Apparatus for use in issuing an audible alert or a tactile alert from a pager comprising:

audible alert generating means;

tactile alert generating means;

means for sensing an ambient sound level;

means responsive to receipt of a page for actuating said audible alert generating means or said tactile alert generating means as a function of said sensed ambient sound level at a time of said page; and means for making a determination as to whether or not said pager is on the person of a user and wherein said means for actuating actuates said audible alert generating means or said tactile alert generating means as a joint function of said sensed ambient sound level and determination.

7. The invention as defined in claim 6 wherein said audible alert generating means and said means for sensing an ambient sound level share a common electro-acoustic transducer.

* * * * *